US005267804A

United States Patent [19]

Baumgarten

[11] Patent Number: 5,267,804

[45] Date of Patent: Dec. 7, 1993

[54] APPARATUS AND METHOD FOR MAKING A BINDER SELF-SUPPORTING

[76] Inventor: Hans J. Baumgarten, 544 Armour Cir., NE., Atlanta, Ga. 30324

[21] Appl. No.: 767,644

[22] Filed: Sep. 30, 1991

[51] Int. Cl.[5] ..... B42F 13/00

[52] U.S. Cl. ..... 402/80 R; 211/126; 402/80 L; 402/73

[58] Field of Search ..... 211/126, 50; 402/80 R, 402/80 P, 80 L, 73, 78, 502; 281/15.1, 20

[56] References Cited

U.S. PATENT DOCUMENTS

| | | | |
|---|---|---|---|
| 169,536 | 11/1875 | Glover . | |
| 255,447 | 3/1882 | Nauerth | 402/73 X |
| 530,806 | 12/1894 | Tilton | 402/73 X |
| 2,180,997 | 11/1939 | Rubilino . | |
| 3,480,154 | 11/1969 | Telfer | 211/126 |
| 4,157,757 | 6/1979 | Gallagher, Jr. | 402/502 X |
| 4,531,764 | 7/1985 | Chang | 402/80 R X |
| 4,569,613 | 2/1986 | Thomas | 402/80 R |
| 4,744,689 | 5/1988 | Sternberg | 402/73 |
| 5,002,416 | 3/1991 | Serzen | 402/80 P X |

FOREIGN PATENT DOCUMENTS

| | | | |
|---|---|---|---|
| 30747 | 5/1920 | Norway | 402/80 L |

*Primary Examiner*—Paul A. Bell
*Attorney, Agent, or Firm*—Michael V. Drew

[57] ABSTRACT

An apparatus (10) for making a binder self-supporting has a right-angular shaped side wall (20) of a height approximately equal to the width of the spine (34) of a binder (30). The right-angular shaped side wall is perpendicularly connected to a right-angular shaped bottom wall (22). The right-angular shaped bottom wall (22) is affixed to the inside surface (38) of either the front or back cover (36) of the binder (30). Once the apparatus (10) is affixed to the binder (30), the open edge of the binder (30), which is opposite the spine (34), presents a box-like configuration. The edge (24) of the right-angular shaped bottom wall (22) is bevelled so that sheets filed in the binder (30) more easily pass over that edge (24).

11 Claims, 3 Drawing Sheets

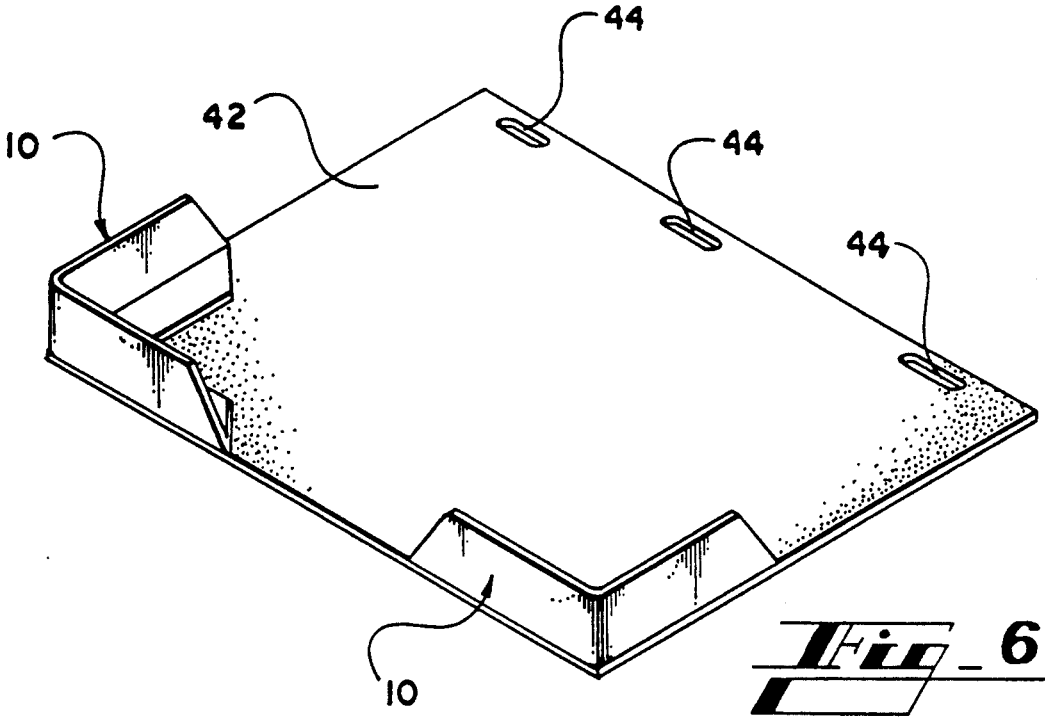
Fig_6
Fig_7
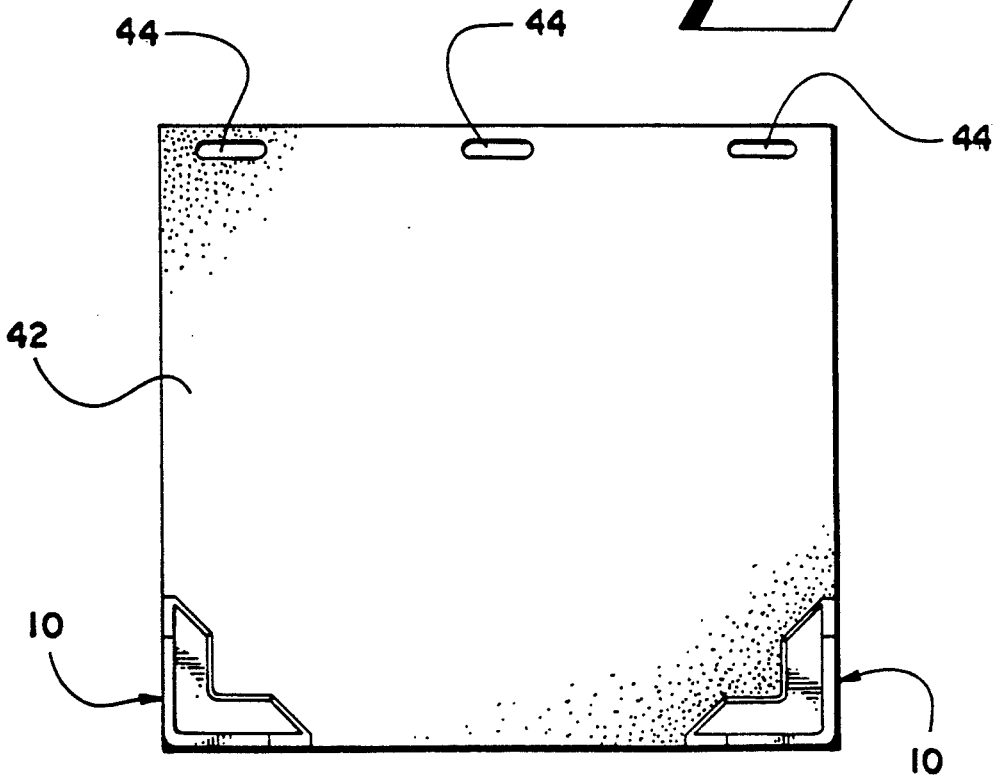

APPARATUS AND METHOD FOR MAKING A BINDER SELF-SUPPORTING

TECHNICAL FIELD OF THE INVENTION

The present invention relates to binders, and more particularly to an apparatus and method for making a binder self-supporting.

BACKGROUND OF THE INVENTION

It is often desirable to stand a binder upright for storage or display. If the papers or other sheets stored in the binder do not form a stack of a thickness approximately equal to the width of the spine of the binder, the edge of the binder opposite the spine will be too narrow to enable the binder to remain upright. It may be desirable to stand the binder upright before enough papers are filed to accumulate a stack of sufficient thickness.

SUMMARY OF THE INVENTION

It is an object of the invention to provide a means for making a binder self-supporting.

The present invention provides an apparatus having a right-angular shaped side wall of a height approximately equal to the width of the spine of a binder. The right-angular shaped side wall is perpendicularly connected to a right-angular shaped bottom wall. The right-angular shaped bottom wall is affixed to the inside surface of either the front or back cover of the binder. Once the apparatus is affixed to the binder, the open edge of the binder, which is opposite the spine, presents a box-like configuration. The edge of the right-angular shaped bottom wall is bevelled so that sheets filed in the binder more easily pass over that edge.

Other aspects, objects, features, and advantages of the present invention will become apparent to those skilled in the art upon reading the detailed description of preferred embodiments in conjunction with the accompanying drawing and appended claims.

BRIEF DESCRIPTION OF THE DRAWINGS

FIG. 6 is an isometric illustration of an additional embodiment of an apparatus for making a binder self-supporting.

FIG. 7 is a plan view of the invention of FIG. 6.

DETAILED DESCRIPTION OF A PREFERRED EMBODIMENT

While the specification concludes with claims particularly pointing out and distinctly claiming the subject matter which is regarded as the present invention, the invention will now be described with reference to the following description of an embodiment taken in conjunction with the accompanying drawings.

Figure 1:
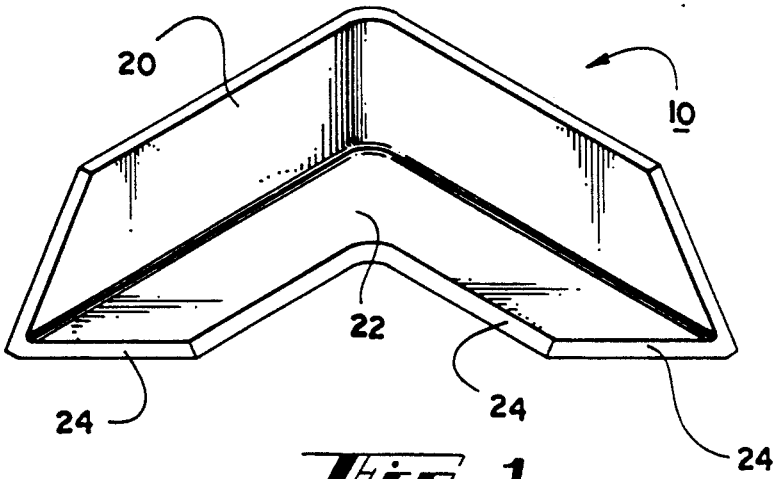
FIG. 1 is an isometric view of a preferred embodiment of an apparatus for making a binder self-supporting.

Referring initially to FIG. 1, therein is illustrated a preferred embodiment of an apparatus 10 for making a binder self-supporting. The apparatus 10 is designed to fit between the covers of a binder to separate the opening edge of the binder and make the opening edge box-like. In turn, this maintains the closed binder in a box-like configuration even when the binder holds only a few papers. A binder which holds only a few papers has a wedge shape when closed. A wedge shape makes standing the binder upright difficult whereas the box-like shape maintained by the apparatus 10 enables the binder to stand upright. FIGS. 1, 2, 3, and 4 may be reference collectively to achieve an understanding of the invention. The apparatus 10 has a side wall 20 which is configured at a right angle. The side wall 20 is perpendicularly connected to a bottom wall 22. The bottom wall 22 also has a right angular configuration. The edge 24 of the bottom wall 22 which is opposite the intersection of the bottom wall 22 and side wall 20 may be bevelled. When bevelled, as illustrated, the edge 24 provides an inclined surface for contact with papers filed in a binder. Papers or other sheets more easily pass over the bevelled edge.

Adhesive strips 26 affixed along each leg of the right angle of to the rear surface of the bottom wall 22 of the apparatus 10 enable the apparatus 10 to be easily affixed to a binder cover. Other means of affixing the apparatus 10 to a binder cover include an adhesive, so-called double-stick tape and hook-and-loop type fasteners.

Figure 5:
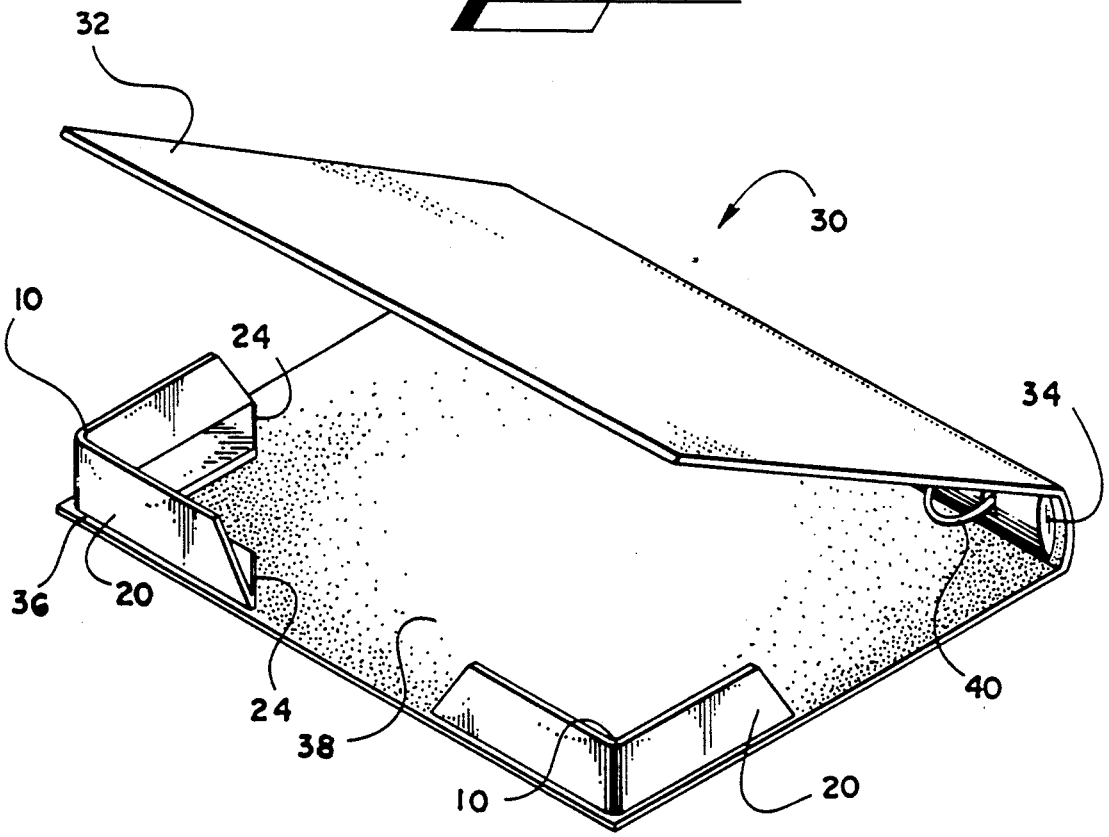
FIG. 5 is an illustration of the apparatus of FIG. 1 in combination with a binder.
Figure 4:
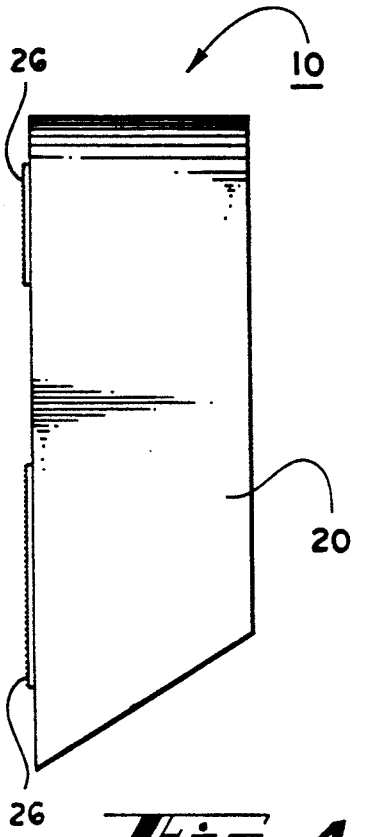
FIG. 4 is a front elevational view of the invention of FIG. 1.
Figure 2:
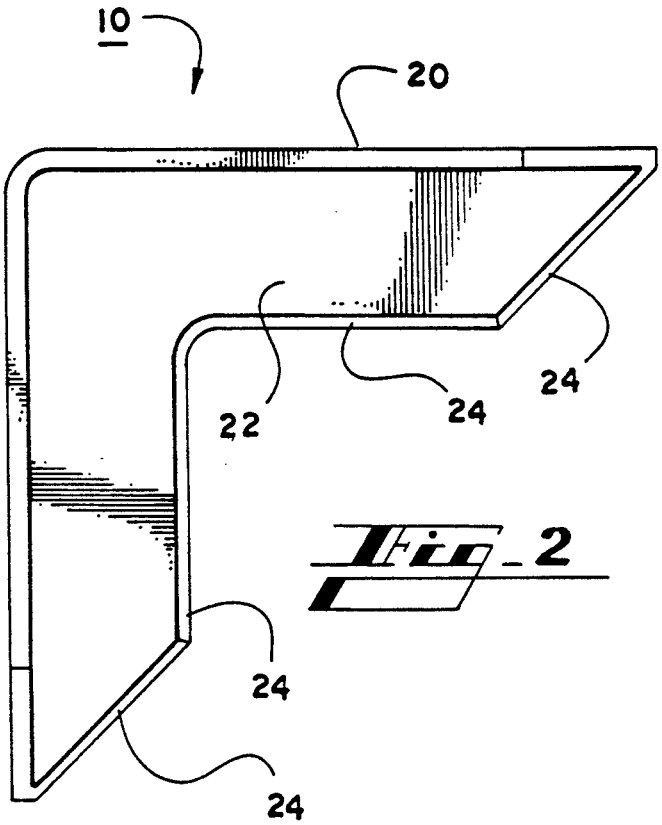
FIG. 2 is a top plan view of the invention of FIG. 1.
Figure 3:
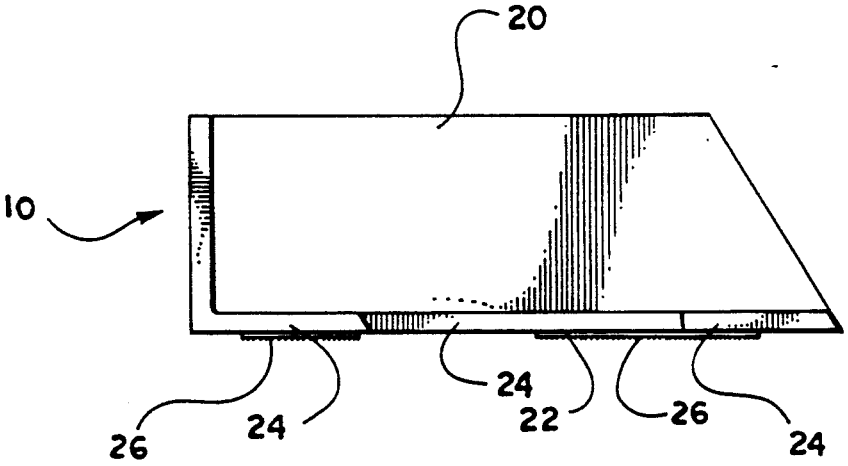
FIG. 3 is a side elevational view of the invention of FIG. 1.

Referring now to FIG. 5, therein is illustrated a preferred embodiment of a method for making a binder self-supporting. A binder 30 has a front cover 32 and a rear cover 36 which open about a spine 34. The apparatus 10 described above is affixed to an inside surface of one of the covers. Although it is possible to install only one apparatus 10 on a single cover 32 or 36, or one apparatus 10 on each cover 32 and 36, it is easier to create the desired box-like effect by installing a pair upon the inside surface of one cover. In FIG. 5, a pair of apparatus 10 is illustrated affixed to the inside surface 38 of the rear cover 36 of the binder. The apparatus 10 may be affixed by any suitable means that will hold them in place. An example of means of affixing an apparatus 10 is the use of an adhesive. Similarly, so-called double-stick tape may be used. Also, hook-and-loop type fasteners could be used. When hook-and-loop type fasteners are used, the apparatus 10 may be removed as desired, such as when the binder contains sufficient sheets to be self-supporting. When a pair of apparatus 10 is installed as shown, the opening edge of the binder 30 is maintained at the height of the side wall 20 of the apparatus 10. The optimum height of a side wall 20 is approximately equal to the thickness of the spine 34 of the binder 30. This helps to create a relatively parallel-sided box. Such a box is easy to stand upright because it supports itself on an essentially U-shaped based formed by the front cover 32, spine 34 and rear cover 36. Without the use of the apparatus 10, the binder 30 holding only a few pages would have to support itself on a triangular base formed by the front cover 32, spine 34 and rear cover 36. The apparatus 10 also helps to maintain pages in place in an upright binder 30 because they are supported by the side walls 20 of the binder 30 when the binder 30 is stood upright.

Referring now to FIGS. 6 and 7, in an additional embodiment of the invention, the apparatus 10 may be affixed to a sheet 42 containing slots 44 corresponding to the rings 40 of a binder 30. In this embodiment, the invention is simply installed by inserting the sheet 42 containing the apparatus 10 into the binder 30. The perimeter of the sheet 42 is slightly larger than the perimeter of page which will be contained in the binder. This is so the pages will fit easily within the apparatus 10 and binder 30. To further insure proper enclosure of pages in within the apparatus 10 and sheet 42 the slots 44 of the insert sheet 42 may be sized slightly longer and wider than the cross section of a binder ring 40 to allow for slight movement of the sheet insert 42 to accommodate pages whose holes may not be precisely aligned with other pages which are also inserted or pages whose holes may not be precisely aligned with slots 44 which have no tolerance. A suitable size for the slots is 0.50 inch longitudinally and 0.25 inch laterally.

The invention also enables partially filled binders to be turned on their sides horizontally and stacked one on another on the binders' sides. This cannot be easily accomplished with partially-filled binders that have a wedge-shaped configuration. The box-like configuration of a partially-filled binder which utilizes the invention enables the binders to be stored in vertical stacks like books.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. An apparatus for enabling a binder having a front cover and a rear cover connected to a spine to be self-supporting when stood upright comprising a right-angular shaped side wall having a height approximately equal to a width of the spine of the binder perpendicularly connected to a right-angular shaped bottom wall and means for attaching said right-angular shaped bottom wall to an inner surface of one of the front cover and rear cover of the binder.

2. The invention of claim 1, said right-angular shaped bottom wall having a bevelled right-angular edge distal said right-angular shaped side wall.

3. The invention of claim 1, further comprising means for attaching said right-angular shaped bottom wall to the inner surface of one of the front cover and rear cover of the binder.

4. The invention of claim 3, said means for attaching said right-angular shaped bottom wall to the inner surface of one of the front cover and rear cover of the binder comprising an adhesive.

5. The invention of claim 3, said means for attaching said right-angular shaped bottom wall to the inner surface of one of the front cover and rear cover of the binder comprising double-stick adhesive tape.

6. The invention of claim 3, said means for attaching said right-angular shaped bottom wall to the inner surface of one of the front cover and rear cover of the binder comprising a hook-and-loop type fastener.

7. In combination with a binder having a front cover and a rear cover connected to a spine the improvement comprising a right-angular shaped side wall having a height approximately equal to a width of the spine of the binder perpendicularly connected to a right-angular shaped bottom wall attached to said right-angular shaped bottom wall to an inner surface of one of the front cover and rear cover of the binder whereby a front edge of the binder is made approximately the same depth as the spine of the binder.

8. The invention of claim 7, said right-angular shaped bottom wall having a bevelled right-angular edge distal said right-angular shaped side wall.

9. The invention of claim 7, wherein said right-angular shaped bottom wall is attached to an inner surface of one of the front cover and rear cover of the binder by means of an adhesive.

10. The invention of claim 7, wherein said right-angular shaped bottom wall is attached to an inner surface of one of the front cover and rear cover of the binder by means of double-stick adhesive tape.

11. The invention of claim 7, wherein said right-angular shaped bottom wall is attached to an inner surface of one of the front cover and rear cover of the binder by means of a hook-and-loop type fastener.

* * * * *